US007874172B2

(12) United States Patent
Cruz et al.

(10) Patent No.: US 7,874,172 B2
(45) Date of Patent: Jan. 25, 2011

(54) DAMPER

(75) Inventors: Marco Antonio Solis Cruz, Queretaro (MX); Victor Hugo Miranda Razo, Guanajuato (MX)

(73) Assignee: MABE, Mexico S. DE R.L. DE C.V., Queretaro, QRO (MX)

( * ) Notice: Subject to any disclaimer, the term of this patent is extended or adjusted under 35 U.S.C. 154(b) by 381 days.

(21) Appl. No.: 12/173,178

(22) Filed: Jul. 15, 2008

(65) Prior Publication Data

US 2009/0151376 A1 Jun. 18, 2009

(30) Foreign Application Priority Data

Dec. 18, 2007 (MX) ..... MX/A/2007/016337

(51) Int. Cl.
*F25D 17/04* (2006.01)
*F24F 7/00* (2006.01)

(52) U.S. Cl. ..... 62/187; 62/186; 62/408; 236/49.5

(58) Field of Classification Search ..... 62/186, 62/187, 408, 255, 418; 236/49.5
See application file for complete search history.

(56) References Cited

U.S. PATENT DOCUMENTS

| | | | |
|---|---|---|---|
| 3,364,694 | A | 1/1968 | Cohen et al. |
| 3,793,847 | A | 2/1974 | Scarlett et al. |
| 3,866,437 | A | 2/1975 | Spencer et al. |
| 3,921,416 | A | 11/1975 | Murnane et al. |
| 4,241,589 | A | 12/1980 | Grimm et al. |
| 4,642,998 | A | 2/1987 | Kang et al. |
| 4,914,928 | A | 4/1990 | Fellwock et al. |
| 5,097,675 | A | 3/1992 | Elsom et al. |
| 6,073,458 | A | 6/2000 | Kim |
| 6,199,400 | B1 | 3/2001 | Banicevic et al. |
| 6,240,735 | B1 | 6/2001 | Kolson et al. |
| 6,250,092 | B1 | 6/2001 | Lanz et al. |
| 6,336,339 | B1 | 1/2002 | Joung et al. |

(Continued)

FOREIGN PATENT DOCUMENTS

| | | |
|---|---|---|
| JP | 61282683 | 12/1986 |

(Continued)

*Primary Examiner*—Chen-Wen Jiang
(74) *Attorney, Agent, or Firm*—Enrique J. Mora, Esq.; Beusse, Wolter, Sanks, Mora & Maire, P.A.

(57) ABSTRACT

An air flow control mechanism for a refrigerator or freezer is disclosed comprising at least one knob to regulate by its adjustment, air flow within a compartment, the knob including at least one end, and wherein said knob is configured to rotate, a cam including a base, a groove and a receiving end, wherein the cam base includes the groove, wherein the groove is a semi-circular shape and is un-centered with regards to the cam base and wherein said receiving end receives said knob end, a crank having a first end a second end, wherein said first end is inserted in the semi-circular groove of said cam base and is configured to run said groove when the user adjusts the knob, a rod having a front end and a back end, wherein said front end is connected to said crank second end, and an obturator connected with said rod back end. Said cam base has the same rotation degree than the knob and wherein the rotational movement of said knob is transformed and transmitted to the crank and consequently the rod.

18 Claims, 17 Drawing Sheets

U.S. PATENT DOCUMENTS 6,647,740 B2 11/2003 Noritake

FOREIGN PATENT DOCUMENTS

| | | | |
|---|---|---|---|
| JP | 1203878 | | 8/1989 |
| JP | 9292173 | A | 11/1997 |
| JP | 10122723 | A | 5/1998 |
| KR | 20040049610 | | 6/2004 |
| KR | 200440049616 | | 6/2004 |
| WO | WO 2004029527 | A2 | 4/2004 |

DAMPER

Related Applications

This application claims priority from Mexican application Ser. No. MX/a/2007/016337filed Dec. 18, 2007, which is incorporated herein by reference in its entirety.

FIELD OF THE INVENTION

The present invention refers to mechanisms and methods for controlling air flow in refrigerators, and specifically to mechanisms and methods for controlling and regulating cold air to be provided to the inner refrigerator compartment.

PRIOR ART DESCRIPTION

A typical refrigerator construction comprises two compartments: a freezer compartment and a refrigerator or fresh food compartment. To provide cold air from the air chamber a fan is used, sucking air coming from the evaporator and supplying kinetic energy to the air, so that said air may reach both compartments by means of ducts. The air is divided and distributed by means of a liner fixed to the evaporator housing and placed in front of the ventilator. That is, a portion of cold air generated in the evaporator is guided to the freezer compartment by a fan or any other means that force the air flow through the ducts. The air guided to the freezer circulates in the freezer chamber, reaching temperatures from −15° to −22° C. The circulating air in the freezer chamber returns to the starting point, through return sections placed somewhere in the compartment liner.

To guide the other portion of cold air generated in the evaporator to the refrigerator compartment, the air chamber is coupled to a cold air duct, normally placed in the back part of the refrigerator compartment. The cold air flow guided by the duct in the back part of the refrigerator compartment, is controlled by a flow control mechanism, air valve or damper, usually placed in the upper portion of the duct. The circulating air within the refrigerator compartment returns through return sections placed somewhere in the fresh food compartment liner. The return sections lead to the evaporator end by means of ducts placed in the back part of the compartments, the air coming from the compartments by the return sections is mixed in the evaporator end with the air coming from the freezer compartment.

If the air flow controlling mechanism is manual, the mechanism is operated in response to a knob operation. If the air flow controlling mechanism is automatic, it will operate in response to signals given by at least one temperature sensor.

Several disadvantages exist in the known controllers, such as production cost, number of pieces needed to complete the product, thus the possibility of a malfunction is greater, the operation of the mechanism is complicated, the knob location may be cumbersome, the life expectancy of present models may be short, and a lack of adaptability of the mechanism to diverse refrigerator models.

Several prior art documents have attempted to provide a solution to the afore-mentioned problems; specifically, Japanese patent No. 61282683 discloses an electromagnetic controller with a fulcrum and pivot shaft system. By means of both, the controlling mechanism is placed in one of the ends, opening and closing the air flow. Japanese patent No. 10122723 discloses a refrigerator controlling mechanism using a mechanism with rotating plates coupled to a cylindrical pivot. The displacement of centers between the cam and the pivot allow the aperture and closing of the controlling mechanism.

U.S. Pat. No. 3,793,847 discloses a refrigerator controlling mechanism, comprised of two elements, a first one that allows manually opening and closing air flow in the upper part of the refrigerator and a second one that controls the inner temperature level. U.S. Pat. No. 3,866,437 discloses an adjustable controlling mechanism between the freezer and refrigerator, providing a set of positions for the controlling mechanism. The mechanism comprises: a manually adjusting control knob, which is placed far from the controlling mechanism by means of a connecting rod and a plate connected to the controlling mechanism. The knob contains a cam that when rotated, displaces the rod and its controlling mechanism. The controlling mechanism is housed between walls, wherein the air enters by the main structure wall, such that the controlling mechanism regulates the volumetric flow for each position, wherein the first position is maximum air flow and the last position is minimum air flow.

U.S. Pat. No. 4,241,589 discloses a refrigerator air flow control assembly, wherein the freezer is found in the upper part and the refrigerator in the lower part, the compartments being connected by an air duct in the back part with an assembly to control air flow. U.S. Pat. No. 4,642,998 discloses a refrigerator air flow control apparatus comprising a mobile obturator, which is mounted in the duct center and wherein the obturator is manually operated. The obturator control operates between the refrigerator and freezer. A control actuator transmits movement to a rod and cam to trace the controlling mechanism displacement route.

U.S. Pat. No. 4,914,928 discloses a refrigerator manual air controlling mechanism, wherein the refrigerator is separate from the freezer by a front control panel and perpendicular to the separation wall, existing an air flow duct between both compartments in the back part of the panel. The control mechanism that is slidably mounted over the duct, regulates exiting air flow. A connecting rod to the control mechanism and a pivot arm, having a connection between ends connected to the control mechanism rod, are moved by movement transmission coming from a control.

U.S. Pat. No. 6,073,458 discloses an apparatus and methods for supplying cold air to a refrigerator interior, wherein some ducts that guide cold air are provided in the refrigerator doors, the refrigerator consisting of an air source, that is a freezer, a supplying duct that guides air towards the door, wherein when the door is closed it is connected with the door duct, in which, at least one of the air exits is opened for the controlled supply by a mechanical controlling mechanism that opens or closes the flow. U.S. Pat. No. 6,199,400 discloses a controlling mechanism for a refrigerator in which the freezer is connected with the refrigerator by an air duct wherein a sliding controlling mechanism assembly actuates by means of a control regulation. The controlling mechanism consists of an extended housing through the upper wall of the refrigerator, a pair of temperature control knobs. The knob controlling mechanism contains a circular connection shape and displacement, an arm is connected in one end with the controlling mechanism, and the other end to the knob, that, by means of rotating movement, linearly displaces the controlling mechanism.

U.S. Pat. No. 6,336,339 discloses a refrigerator controlling mechanism, installed in the cold air flow route, a baffle that allows air flow according to that required, a connecting rod united to the baffle in one end and in the other end a hinge, a gear transmits the movement over the hinge for the movement selection and transmission according to the aperture or closed section. U.S. Pat. No. 6,647,740 discloses a refrigerator controlling mechanism and refrigerator using the same, in which each of the faces, front and back, block a duct branch. The control mechanism operates when actuating the refrigerator or freezer doors. That is, if the freezer compartment door is opened, the controlling mechanism blocks the feeding duct to this area, and likewise, if the refrigerator compartment door is opened, the controlling mechanism blocks the feeding duct to this area.

Therefore, a controlling mechanism that is affordable to produce, with few pieces involved, so that the failing possibilities of the controlling mechanism diminishes, and thus, has a longer life expectancy is required. Also, a simple operation is required, so that the user, and consequently the mechanism is simple to operate. A knob having an operable location for the user is also required, without affecting the refrigerator appearance. Finally, a controlling mechanism capable of having adaptability is required, that is, that it may be adapted to different refrigerator models, wherein the freezer compartment may be disposed in any of various locations, such as an upper location, a lower location or side by side to the refrigerator compartment.

BRIEF DESCRIPTION OF THE PRESENT INVENTION

Aspects of the present invention refer to a refrigerator compartment incoming air flow controlling and regulating mechanism, wherein air flow comes from an evaporator situated near the freezer compartment.

Air flow is guided by means of at least one duct towards the refrigerator compartment. It is usual that said duct is found in the back part of the refrigerator compartment liner. Likewise, it is usual that the air flow discharge ports towards the refrigerator compartment, are found in the liner back and upper part, that is, air flow is emitted from the back part of the compartment towards the front part of the compartment. Air circulating within the refrigerator compartment ends by returning through returns sections, usually placed in the lower part of the compartment liner.

In the front part of the refrigerator compartment, a knob is found, which may be manually adjusted by a user, to regulate incoming air flow to the refrigerator compartment. The knob is capable of rotating a determined number of degrees, e.g. less than 360°. The knob transmits the rotating movement to a connecting rod, by means of a cam and a crank. The cam base is directly connected to the knob, thus the cam base has the same rotation as the knob. The cam comprises an un-centered semi-circular groove with regards to the cam base. A crank end travels through the semi-circular groove, thus movement rotation of the knob is transformed and transmitted to the crank and consequently to the rod.

The knob and cam rotational movement is transformed into a torsion movement of the crank end. Since the groove is un-centered with regards to the cam base, rather proximate to one of the cam edges, the rotation of the crank diminishes the angle relation or rotation degree in comparison to the knob and cam base, being this one of the reasons why the rotation degree diminishes. Since the rod is directly connected to the crank, the rod rotation has the same rotation degree than the crank. Additionally, since the obturator is directly connected to the rod, the same rotation degrees of the crank are transmitted to the obturator by means of the rod.

While the knob, cam and crank may be found in the front part of the compartment or cabinet, so as to facilitate user access, the obturator may be found in the back part of cabinet or compartment. The connection between the knob, cam and crank with said obturator is by means of the rod, which may be found in the upper part of the refrigerator compartment, covered by a housing for appearance purposes.

The obturator is capable of obstructing or allowing air flow that comes from the duct towards the refrigerator compartment.

Therefore, an object of the present invention is to provide an affordable control mechanism to produce, wherein its construction involves few pieces, being this another object of the invention.

Another object of the invention is a control mechanism that may be operated in a simple manner by the user, and when operated, the control mechanism has simple functioning.

Yet a further object of the present invention is providing a control mechanism that as a whole, does not affect the inner appearance of the refrigerator.

Finally, another object of the invention is providing a control mechanism that has adaptability between different refrigerator model.

Other objects and advantages of the invention will become apparent when taking into account the specification in regards to the following figures.

BRIEF DESCRIPTION OF THE FIGURES

The particular features and advantages of the invention, as well as other objects of the invention, will be clear from the following specification, taking into account the following figures, from which.

DETAILED SPECIFICATION OF THE INVENTION

Figure 1:
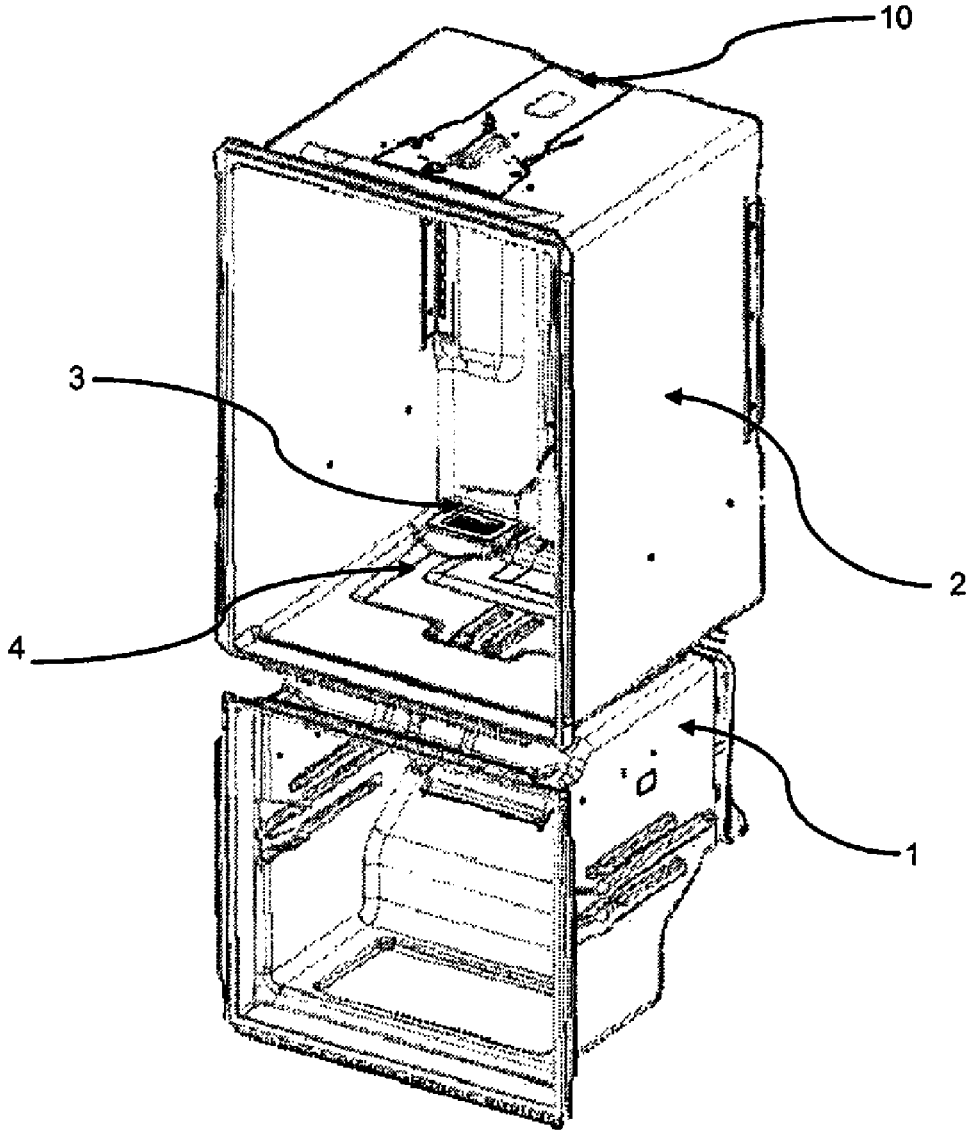
FIG. 1 is a perspective view of the two refrigerator compartments.

FIG. 1 shows two separate compartments. In the case illustrated by FIG. 1, the freezer compartment or cabinet (1) is found in the lower part, while the refrigerator compartment or cabinet (2) is found in the upper part. However, as will be shown, the air flow control mechanism of the present invention is capable of functioning in a refrigerator whose freezer compartment (1) is found in the upper part, while the refrigerator compartment (2) is found in the lower part, or, wherein both compartment (1, 2) are found side-by-side. In the refrigerator cabinet (2) inner part, a return section (3) may be seen, which collect the air circulating within the refrigerator cabinet (2), to send it through a plurality of return ducts (4) towards the evaporator to cool again the air, after mixing it with the collected air from the freezer compartment (1).

In the upper part of the refrigerator cabinet (2) an air flow controlling mechanism (10) may be found.

Figure 2:
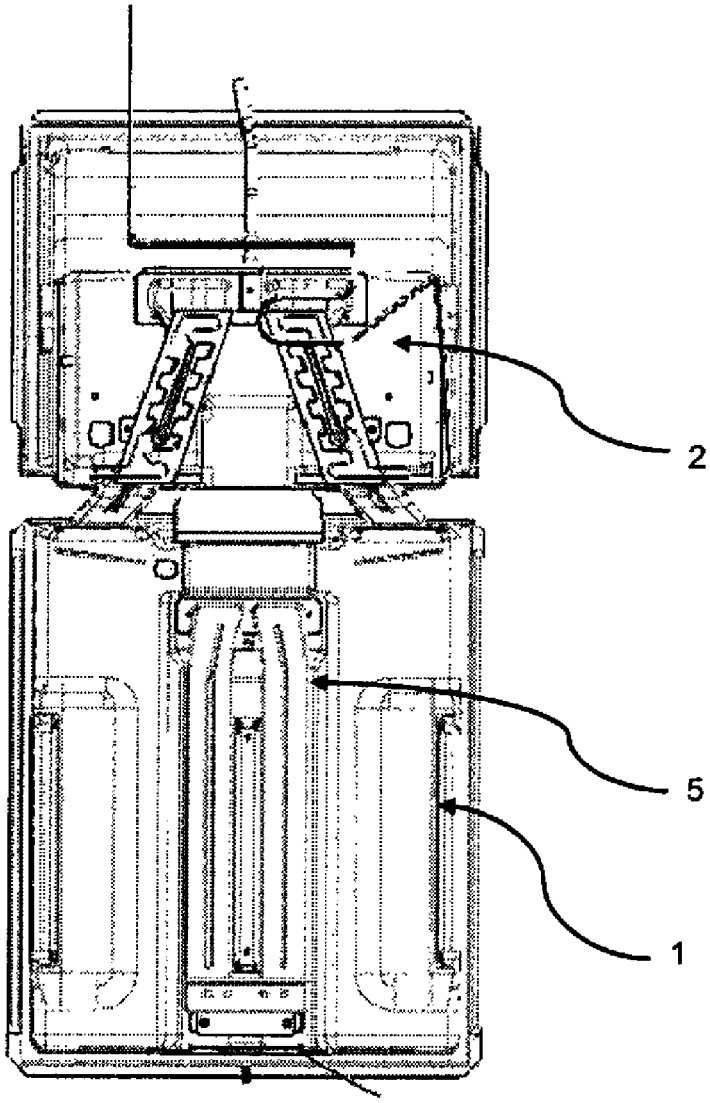
FIG. 2 is a back view of the two refrigerator compartments.

FIG. 2 shows the back part of the cabinets (1, 2) that constitute the refrigerator. Likewise, it may be seen that the supply ducts (5) through which the cold air, generated by a fan and cooled by an evaporator, is guided towards the refrigerator (2).

The evaporator is generally found in the back part of the freezer compartment (1), thus the ducts (5) guide the cold air from upstream in the case illustrated by FIGS. 1 and 2. Said duct (5) is found in the back part of the compartment (1, 2) liners.

Figure 3:
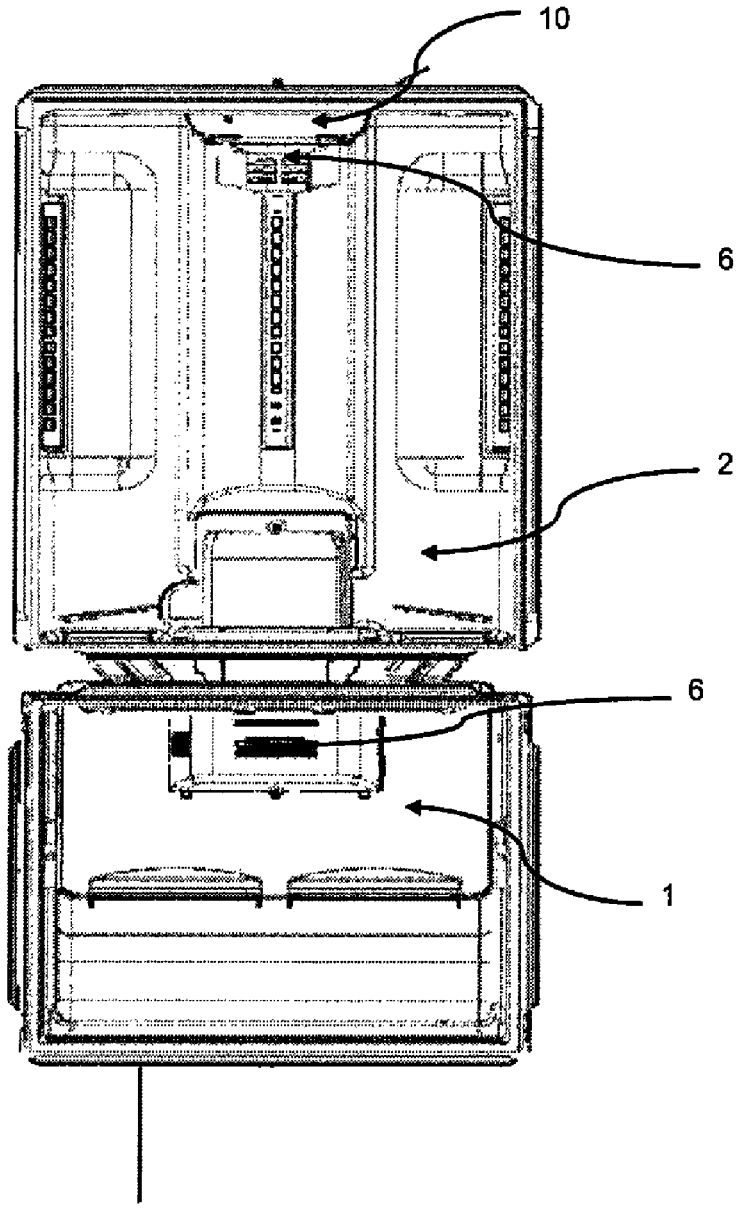
FIG. 3 is a front view of the two refrigerator compartments.

FIG. 3 illustrates a front view of the compartments (1, 2) of a refrigerator. In the back upper part of the freezer compartment, a plurality of discharge ports (6) may be seen, wherein cold air coming from the evaporator is discharged towards the freezer compartment (1). Likewise, in the back upper part of the refrigerator compartment (2) discharge ports (6) may be seen, wherein cold air coming from the evaporator through the ducts (5) is discharged towards the refrigerator compartment.

It is usual that the air flow discharge ports (6) towards the compartments (1, 2), are found in the back upper part of the cabinet (1, 2) liners, so that the air flow, which is emitted from the back part of the compartments (1, 2), may go through the compartments (1, 2) towards the front part of said compartments (1, 2) and thus circulate air throughout said compartments (1, 2). However, air flow may exit from the lateral walls of said compartments (1, 2) and even from the front part.

In the back part of the refrigerator compartment (2), the air flow control mechanism (10) is found. Even though not shown in this figure, a knob of the mechanism (10) is found in the front part.

Figure 4:
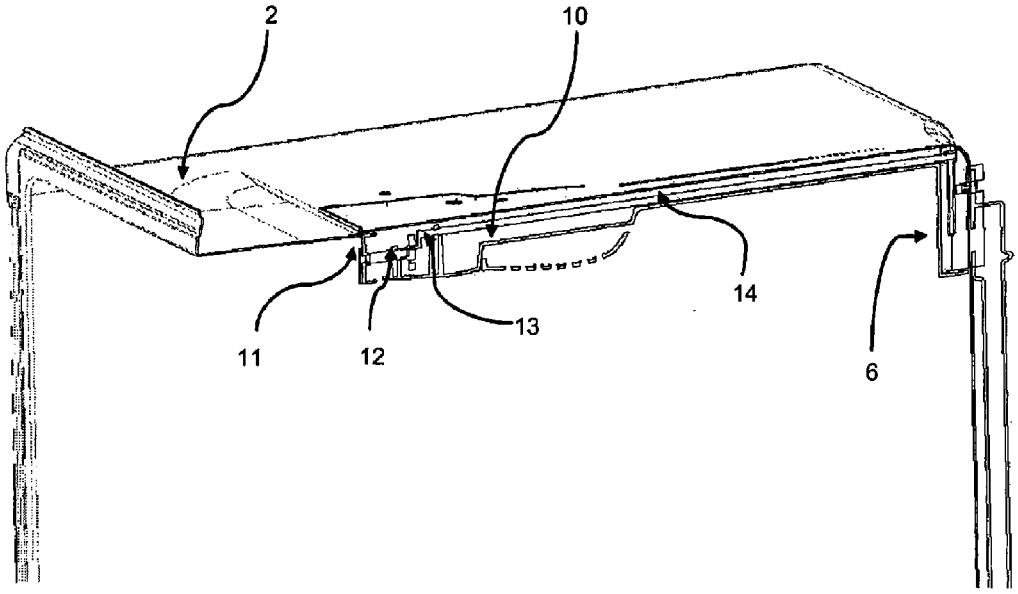
FIG. 4 is a transversal cut of a perspective view of the upper part of the refrigerator compartment.

As seen in FIG. 4, which is a transversal cut in perspective of the upper part of the refrigerator compartment (2), the air flow control mechanism (10) extends from practically the front part towards the back part of the compartment (2). This serves so that the knob (11) is found in the front part of the compartment and is of easy access to the user.

To control air flow discharged in the ports (6) in the back part of the compartment (2), the mechanism has a rod (14), which by means of a cam (12) and a crank (13), translates the rotational movement of the knob (11) to an obturator in the back part, that will obstruct or allow the air flow towards the inner compartment (2) by means of the ports (6).

Figure 5:
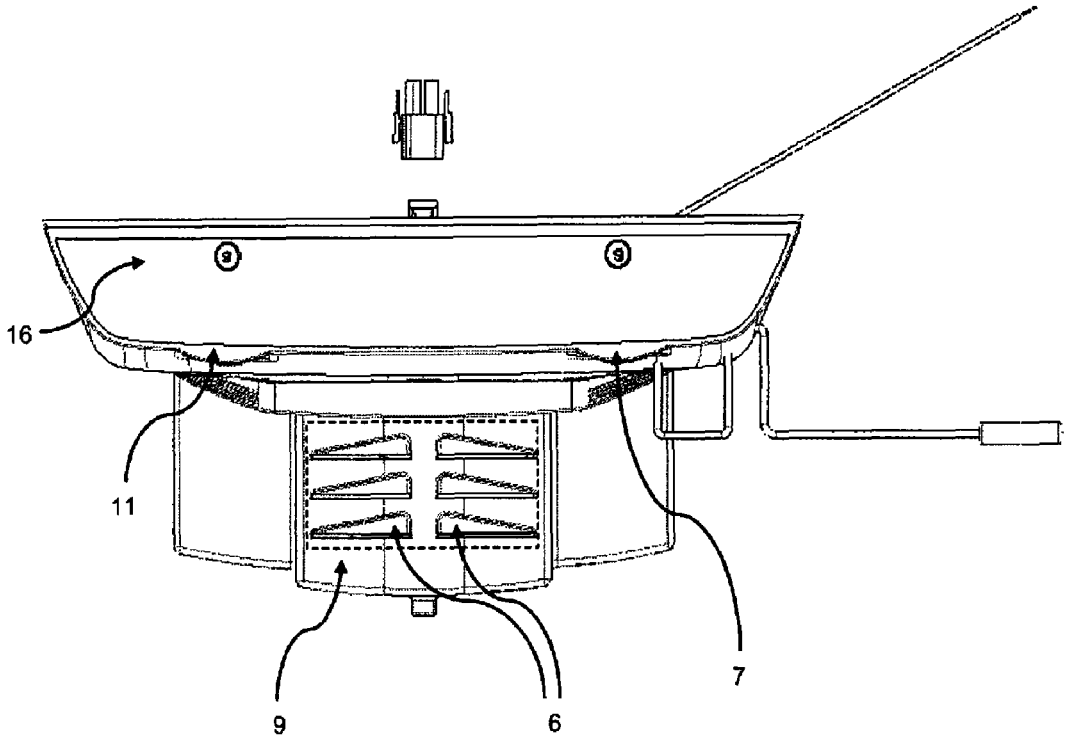
FIG. 5 is a front view of the air flow control mechanism liner of the invention.

FIG. 5 is a front view of air flow control mechanism housing (16), wherein part of the knobs is appreciated, which are manually adjusted by the user and wherein said housing (16) covers substantially the mechanism (10). The first of the two knobs (7) controls the refrigerator (2) temperature, while the second knob (11) allows controlling and regulating incoming air flow to the refrigerator cabinet (2) through the ports (6).

The upper part of the housing (16) is proximal to the upper part of the refrigerator cabinet (2), wherein said housing (16) is found in the inner part of said cabinet (2), thus the knobs (7, 11), i.e. the controls, are accessible by the inner part of the cabinet (2) and the ports (6) are visible when the cabinet is open.

The number of ports (6) is preferably greater than one, and in this embodiment has a triangular shape in view of appearance, however could take any shape. When having a greater number of ports (6), a greater number of air flow routes may be taken by the air, when entering the refrigerator cabinet (2). However, so as to control and regulate air flow, it is preferable to have a limited number of ports (6) and wherein said ports (6) are concentrated in a determined region (9).

Figure 6:
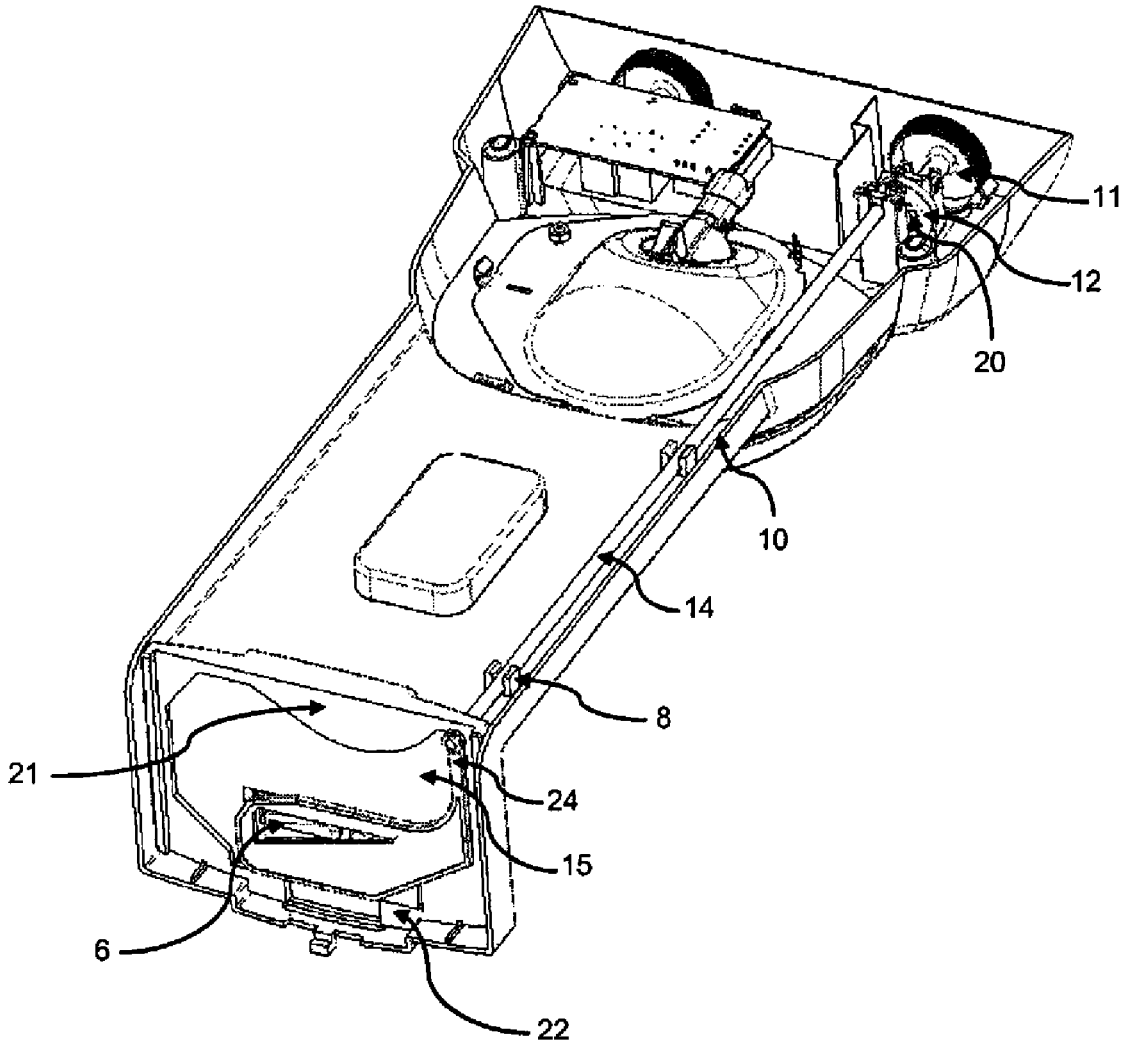
FIG. 6 is a back upper perspective view of the air flow control mechanism of the present invention.

FIG. 6 is a back perspective view of the mechanism (10) of the invention. The mechanism mainly comprises a knob (11), a cam (12) which is directly connected to the knob (11), a crank (13), a connecting rod (14) and an obturator (15). The knob (11) is a substantially circular shape. Likewise, the cam is formed from a base (12) with a semi-circularly shaped groove (20). A crank, not shown in said figure, comprises an end, also not appreciated in the figure, connected with the cam groove (20) by means of said end. On the other hand, the crank is connected to the rod (14) which is fixed to the housing (16) by means of pins (8). The rod (14) runs the length of the housing (16) from front to back communicating the knob (11) with the obturator (15), wherein the obturator (15) is fixed to the back part of the rod (14).

The mechanism functioning will be explained with greater detail in the following figures, however, it should be noted that the cam (12), the crank (13) and the bar (14) transfer the rotation movement from the knob (11) to the obturator (15). However, the rotation degree of the knob (11) is diminished by the cam groove (20) functioning, as well as the crank (13), thus the rod (14) and obturator (15) do not have as many rotation degrees as the knob (11) and cam (12).

The obturator (15) has a semi-rotational displacement, which is limited by the rotation degrees of the knob (11) and the back part of the housing (16) walls. As seen in FIG. 6, the obturator (15) obstructs the air discharge ports (6), thus allowing a minimum air flow towards the inner refrigerator compartment (2). In this case the knob (11) is in an initial position of minimum flow and the obturator (15) is limited by the lower wall (22) in the back part of the housing (16). When the knob (11) is rotated towards a greater flow, the obturator (15) is displaced towards the upper wall (21) of the interior of two EPS blocks placed in the back part of the housing (16), therefore uncovering the ports (6) allowing greater air flow towards the inner refrigerator compartment (2). When the knob (11) finishes its rotation, i.e. rotates the maximum possible in the contrary sense to its original position, the obturator (15) is displaced to the most proximal position to the upper wall (21) and the ports are totally uncovered and thus allow the maximum air flow towards the interior of the refrigerator compartment (2). The upper (21) and lower (22) walls in the interior of the EPS blocks of the back part of the housing (16), demarcate a groove (23) in which free movement of the obturator (15) is allowed, wherein the obturator displacement (15) from the lower wall (22) towards the upper wall (21) is a rotating movement that is determined by the rod (14), since said obturator is fixed in its end (24) to the back end of the rod (14).

Figure 7:
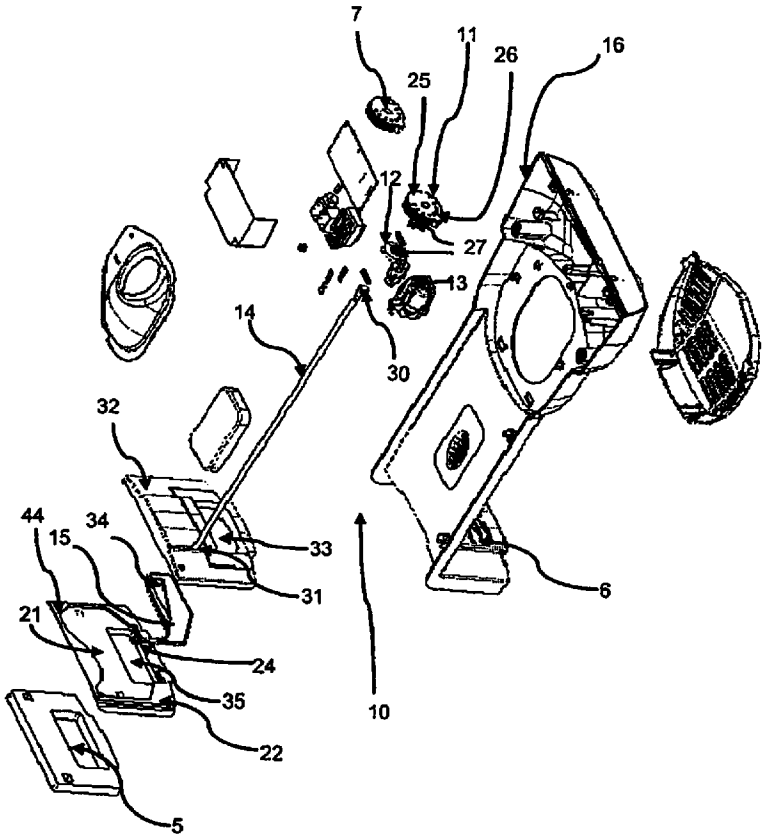
FIG. 7 is an explosion perspective view of the air flow control mechanism.

FIG. 7 is an explosive perspective view of the mechanism (10) of the invention. In the lower part, the housing (16) is found, which supports the mechanism (10).

The housing (16) will help covering aesthetically the mechanism (10), however, it should be understood that it is not an essential feature of the mechanism (10). Since the mechanism is manual and not automatic, the use of a second knob (11) is needed, since said knob (11) allows controlling and regulating incoming air flow towards the refrigerator cabinet (2) by means of the ports (6).

The knob (11) is essentially circular, and contains its front face (25) with a plurality of signals, such as numbers, which are indicative of the incoming air flow towards the refrigerator cabinet (2), and consequently, indicative of the position in which the obturator (15) is found. In its lateral face, the knob (11) may have stop (26) for protection of the mechanism, in view of rotating excess of said knob (11). In the back face, the knob (11) contains a shaft (27), which will allow the connection between said knob (11) and the cam (12).

In the front center part, the cam (12) contains a receptacle (28) which will allow, from the cam (12) side, the connection between said cam (12) and said knob (11). In its back part, the cam (12) contains a groove (20), wherein the crank (13) will be fixed by means of one of its two ends, wherein the first end is found in the lower front part of said crank (13). In the present figure, the crank (13) may be accompanied by a step-motor (29), which will allow the exact positioning of the obturator. However, the mechanism may function without a step-motor (29), as shown in the following figures.

The crank (13) translates the rotating movement of the knob (11) and cam (12) to a torsional movement, the second movement created by the run of the first end of the crank (13) within the cam groove (20). The second end of the crank (13), in the back upper part of said crank (13), again translates the torsion movement to a rod (14) rotating movement. The second end of said crank (13) allows a fixed connection between the crank (13) and the rod (14). Since the second end of the crank (13) and rod (14) are fixed, the rotation center of the crank (13) is found in the connection between the crank (13) and the rod (14).

Since the cam groove (20) is un-centered with regards to said cam (12), the rotation degree of the crank (13), rod (14) and obturator (15) are diminished with regards to the knob (11) and cam rotation degree.

In its front part, the rod (14) has a front end (30), which will serve as a fixed connection to the crank (13) second end. The rod (14) is fixed throughout the housing (16) by means of pins (8). However, said pins (8) allow a free rotation of said rod (14). The rod (14) has a similar longitude than the housing (16), wherein the rod (14) longitude may be slightly shorter. In the back part, the rod (14) has a back end (31) that will be fixed to the obturator (15). The rod (14) goes through a first housing (32) and a second block (44), enclosing the obturator (15) in a shell, wherein the first housing (32) and second block (44), have a lower (22) and upper (21) wall that demark the obturator (15) movement. The first housing (32) and the second block (44) have an aperture (33, 35) that will allow air flow coming from the duct (5). The obturator (15) end (24) allows a fixed connection between said end (24) and said back end (31) of the rod (14). The obturator (15) has a groove (34) that allows minimum air flow, when said obturator (15) is obstructing apertures (33, 35) of the first EPS block of the first housing (32) and the second block (44) of the back part of the housing (16), and consequently, obstructing air flow coming from the duct (5).

Figure 8:
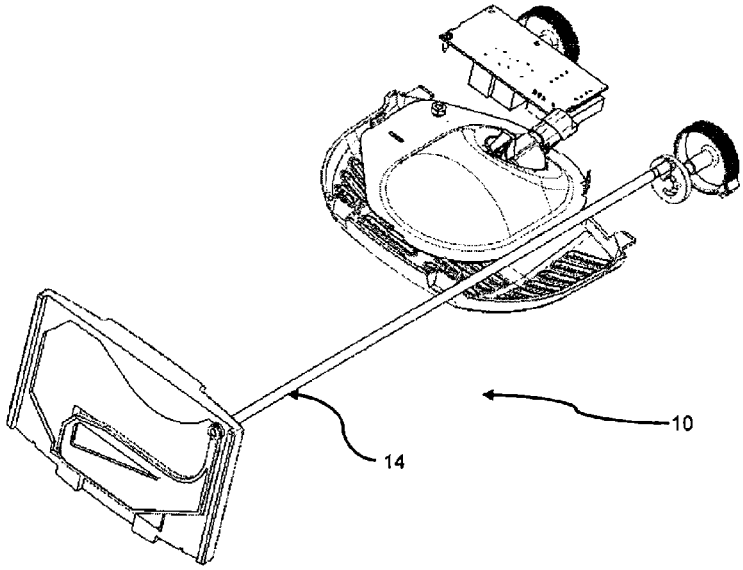
FIG. 8 is a back perspective view of the air flow control mechanism.

FIG. 8 allows seeing in a back perspective view the mechanism (10) of the invention. Since the housing (16) is not shown in said figure, the mechanism (10) components may be seen clearly, being clear that the mechanism (10) is capable of operating without said housing (16). The function of holding the rod (14) with said pins (8) may be substituted with pins coming from the refrigerator compartment (2).

The following figures are detailed views of the particular components of the mechanism.

Figure 9:
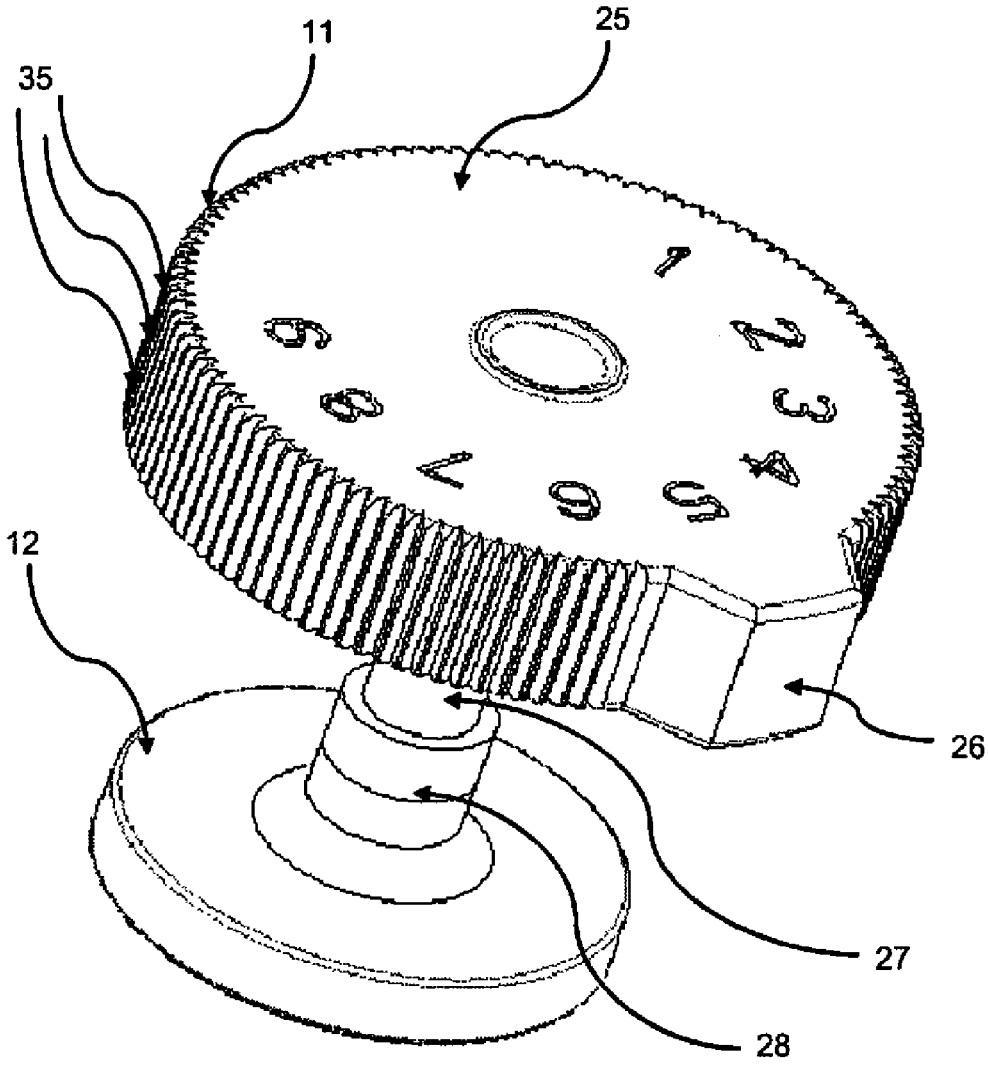
FIG. 9 is a front perspective view of the knob and cam of the air flow control mechanism of the invention.

FIG. 9 is a perspective view of the knob (11) and cam (12). As mentioned before, the knob (11) in its front face has a plurality of indicia, in this case numbers, showing the cold level to the user, and consequently the obturator (15) position. As an illustrative case, the lowest number "1", indicates the maximum air flow towards the inner compartment and coldest level of the refrigerator (2), while the greatest number "9" may be the minimum air flow towards the inner compartment and hottest level of the refrigerator (2).

As was mentioned before, the knob (11) rotation is below 360°, specifically the maximum rotation degree of the knob (11) may range between 250° to 315°, thus the rotation degree between each position, taking into account the prior example of nine positions, is between 27.77 to 35°. In its lateral part, the knob (11) has a stop (26) that will help the user keep the maximum and minimum rotation angles of said knob (11). However, said knob (11) has a series of alternating splines (35) that will help the user rotate the knob (11) with ease.

Figure 10:
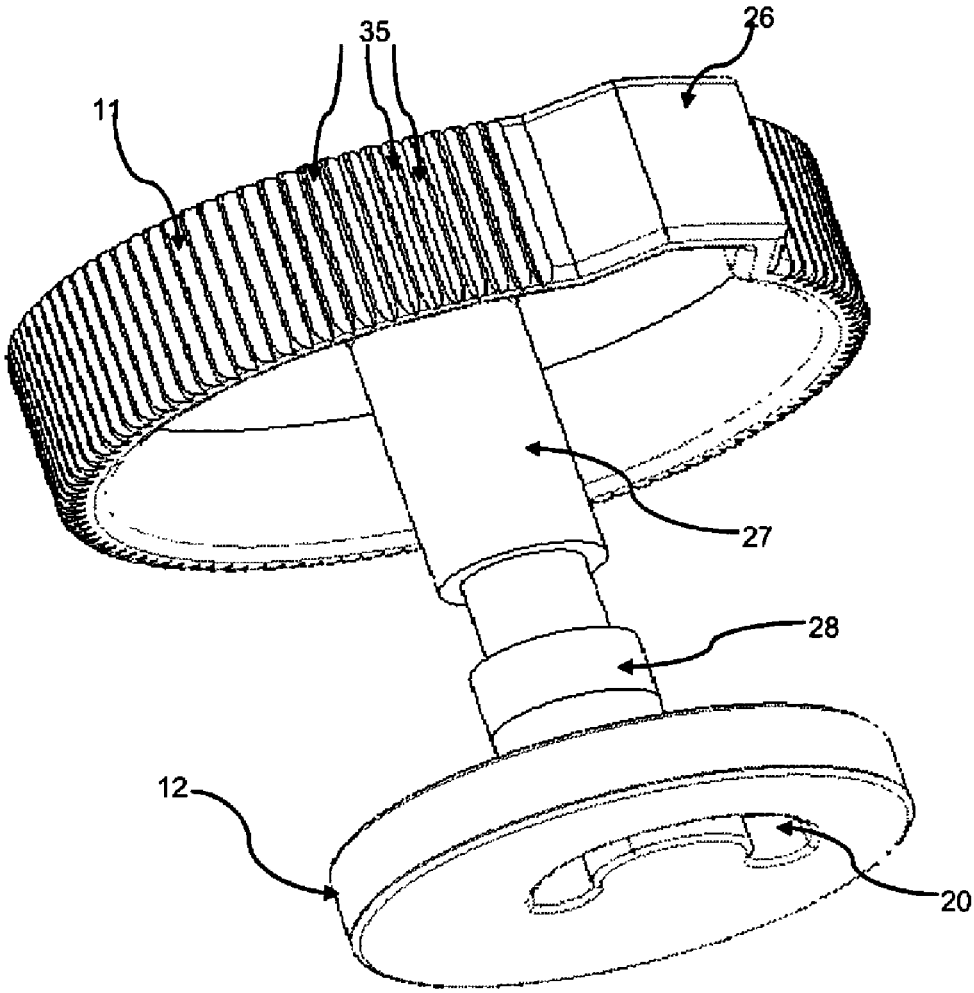
FIG. 10 is a back perspective view of the knob and cam of the air flow control mechanism of the invention.
Figure 11:
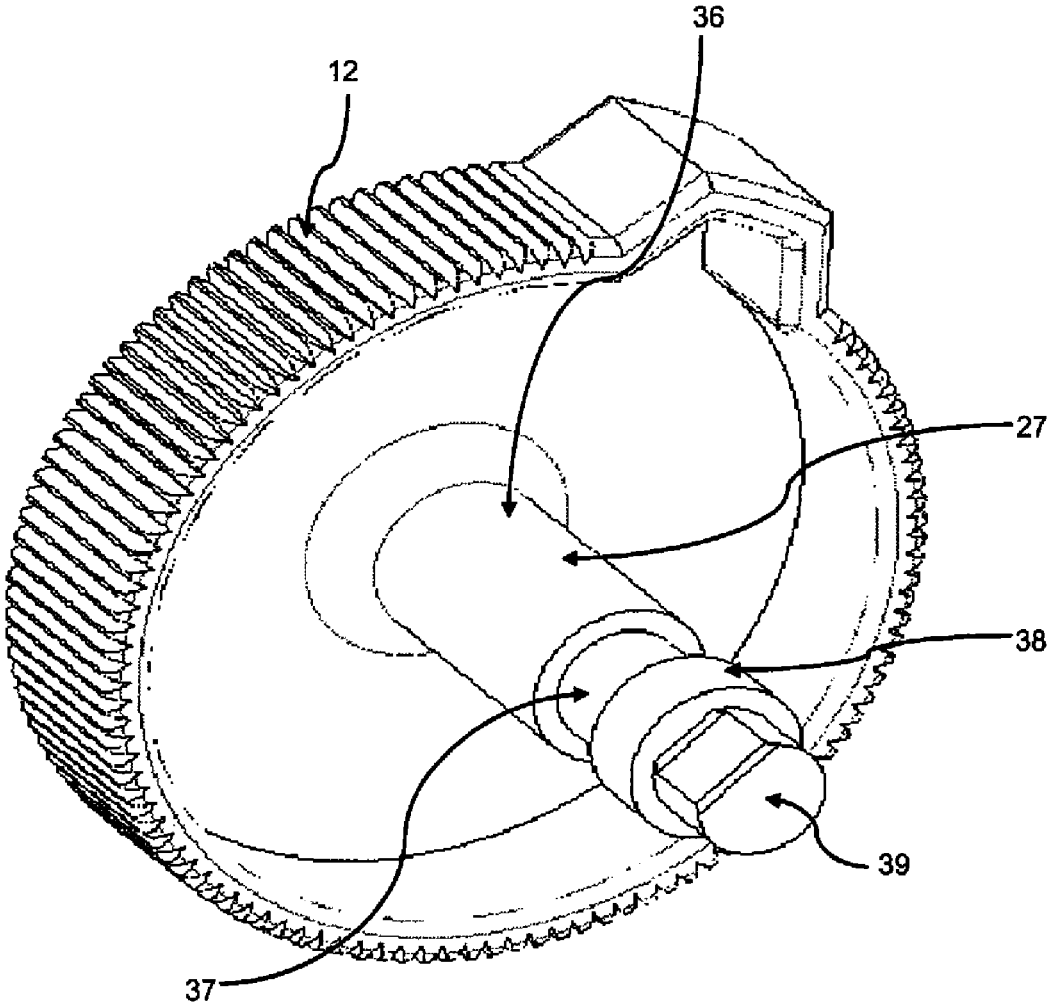
FIG. 11 is a back perspective view of the control mechanism knob of the invention.

The back face of the knob (11) and taking this specification into connection with FIG. 10, a shaft (27) that is generally cylindrical is found, wherein said cylinder may be solid. The initial part of the shaft (27), i.e. the proximal part to the knob (11) is centered with regards to said knob (11), that is, connected to the central part of the circle formed by the knob (11). The final part of said shaft (27), i.e. the distal part to said knob (11) and proximal to the cam (12) is received by a receptacle (28) of said cam (12). The final part of said shaft (27) is inserted and fixed, as shown in FIG. 11, in a hollow cylinder defined by the receptacle (28) of the cam (12). The cam (12) contains said receptacle (28) in hollow cylindrical shape formed by the cam (12), as seen in FIG. 9.

FIG. 10 shows the groove (20) wherein the first end of the crank (13) will be fixed. As seen in this figure, and detailed in FIGS. 13, 14 and 15, the groove is un-centered with regards to the circle center formed by the cam (12) base.

FIG. 11 is a back perspective view of the knob (11). The shaft (27) in cylindrical shape of the knob is conformed by different sections. The initial part of the pin, or first section (36), is a solid cylinder with uniform diameter fixed with the back face of the knob (11). A second section (37) of uniform diameter, is proximal to the first section (36) having a slightly less diameter than the first section (36). A third section (38), proximal to the second section (37), is a uniform diameter equal to that of the first section (36). Finally, the shaft (27) comprises a final part or fourth section (39), proximal to the third section, wherein a cylinder secant of the fourth section (39) is flat with regards to the rest of the cylinder. The diameter, in general, of the fourth section (39) is the same to that of the second section (37).

Figure 12:
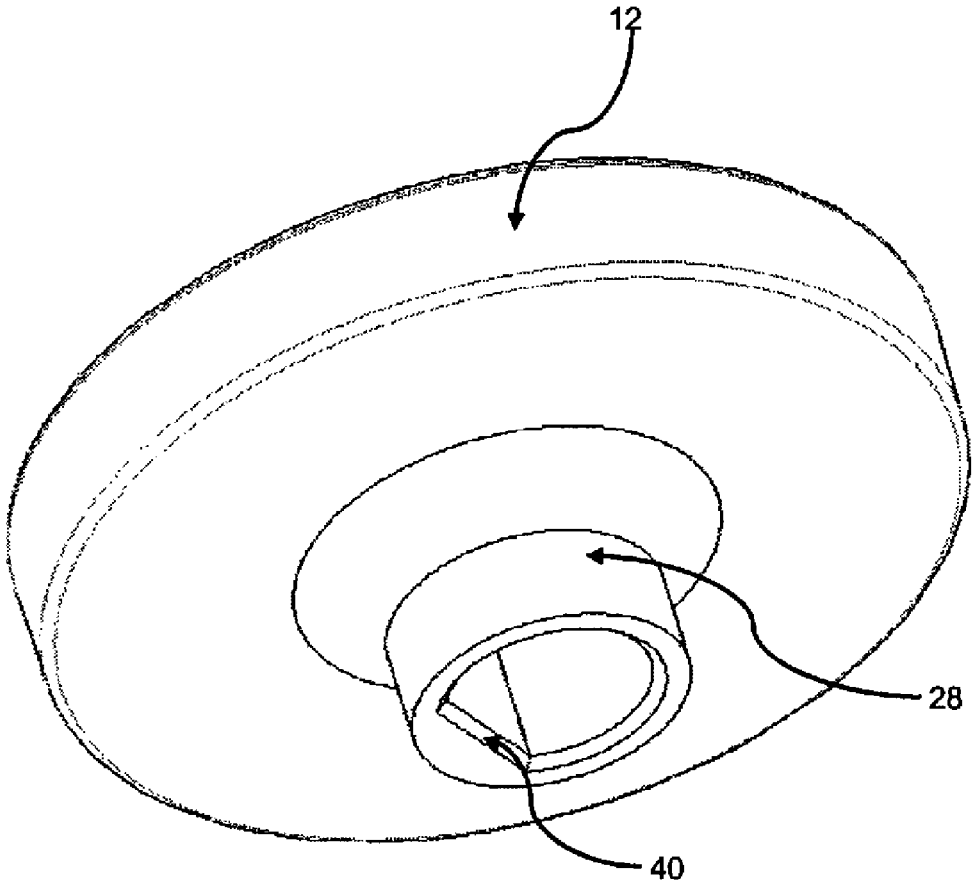
FIG. 12 is a front perspective view of the mechanism cam of the invention.

Taking into account FIG. 11 and FIG. 12 with the following description, the knob (11) shaft (27) fourth section (39), is inserted in the cam (12) receptacle (28), wherein the receptacle (28) is a hollow cylindrical shape. In the internal part of said receptacle (28), a secant wall (40) is found, cutting the shape of the hollow cylinder in the inner part of the receptacle. Therefore, since the fourth section (39) solid cylinder is flat, and the hollow cylinder of the receptacle (28) is inversely flat, the knob (11) shaft (27) fits with the cam (12) receptacle (28), allowing a fixed connection between both parts, that is, between the knob (11) and cam (12).

Figure 13:
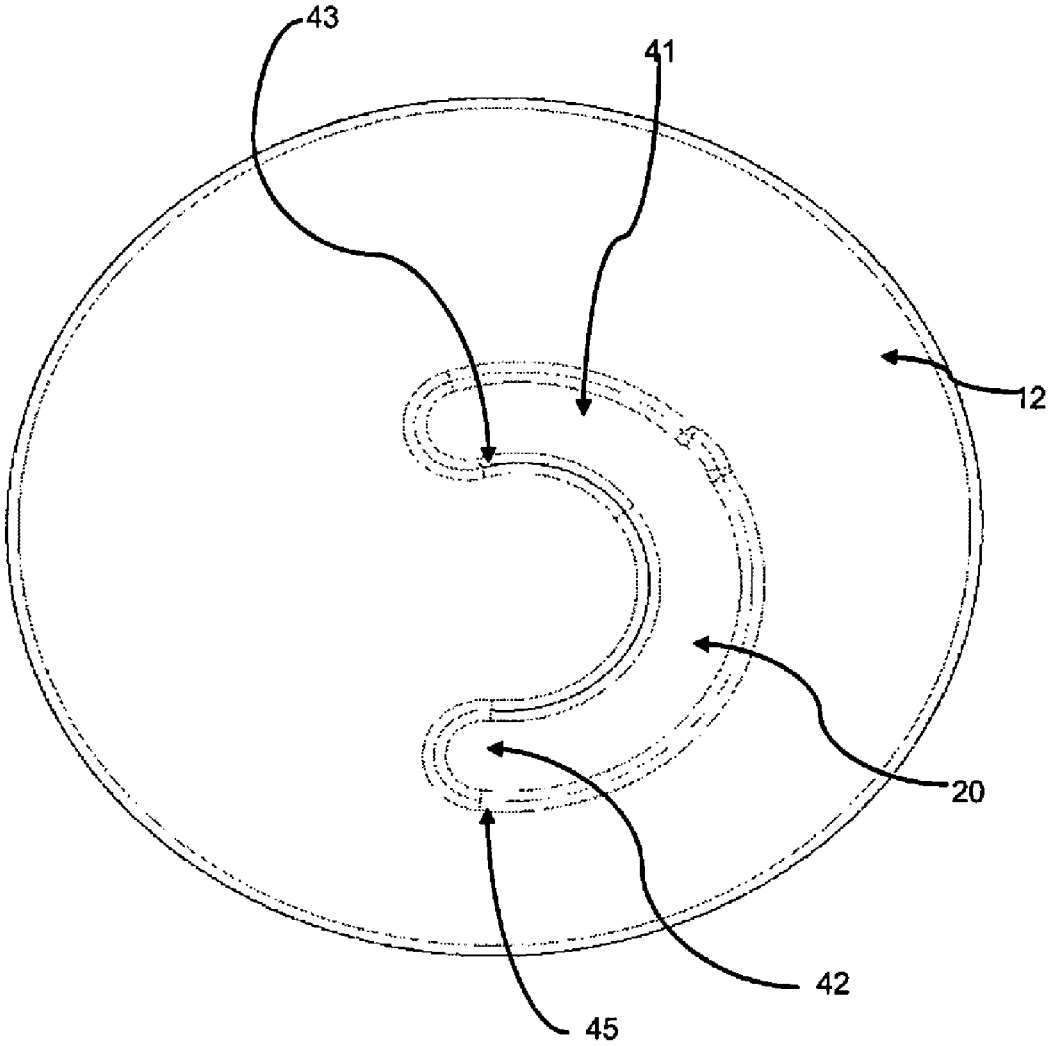
FIG. 13 is a back view of the air flow control mechanism cam of the invention.

FIG. 13 is a view of the cam (12) back face. As seen, the groove (20) is un-centered with regards to circle center formed by the cam (12). The groove (20) is semi-circular shape and its running section is approximately half a circle.

The initial part (41) of the run of the groove (20), i.e. the part where the obturator (15) obstructs air flow and where the knob (11) will be indicating minimum air flow towards the inner refrigerator compartment (2), is proximal to the circle center formed by the cam (12) base.

The final part (42) of the run of the groove (20), i.e. the part where the obturator (15) allows air flow and wherein the knob (11) will be indicating maximum air flow towards the inner refrigerator compartment (2), is a distal point to the center of the circle formed by the cam (12). In fact, the lower wall (45) of the final part (42), is the farthest point of the groove (20) to the center formed by the circular shape of the cam (12).

The lower wall (43) of the initial part (41) of the groove (20) run, is converted in the upper wall of the final part (42) of the groove (20) run, while the upper part of the initial part (41) of the groove (20) run converts in the lower wall (45) of the final part (42) of the groove (20) run, in light of the semi-circular shape of said groove (20).

The groove (20) demarks the run that the first end of the crank (13) will have. The groove (20) serves to guide the first end of the crank (13) in its torsional movement with regards to the cam (12) and rotating with regards to the rod (14). Since said groove (20) is a semi-circular shape, the torsion movement of the first end of the crank (13) is limited to 180° of torsion.

The purpose of the groove (20) being semi-circular, and the groove (20) being un-centered with regards to the circle center formed by the cam (12), is that the rotation degrees carried out by the knob (11) and cam (12), be diminished when transferred to the rod (14) and obturator (15). The rotation degree diminishment is relevant, and may have a rotation degree relation of the knob (11) and cam with the rod (14) and obturator (15) approximately ½ to 1/15, depending on the total groove (20) run, and the position of the groove (20) with regards to the circle center formed by the cam (12) base.

Figure 14:
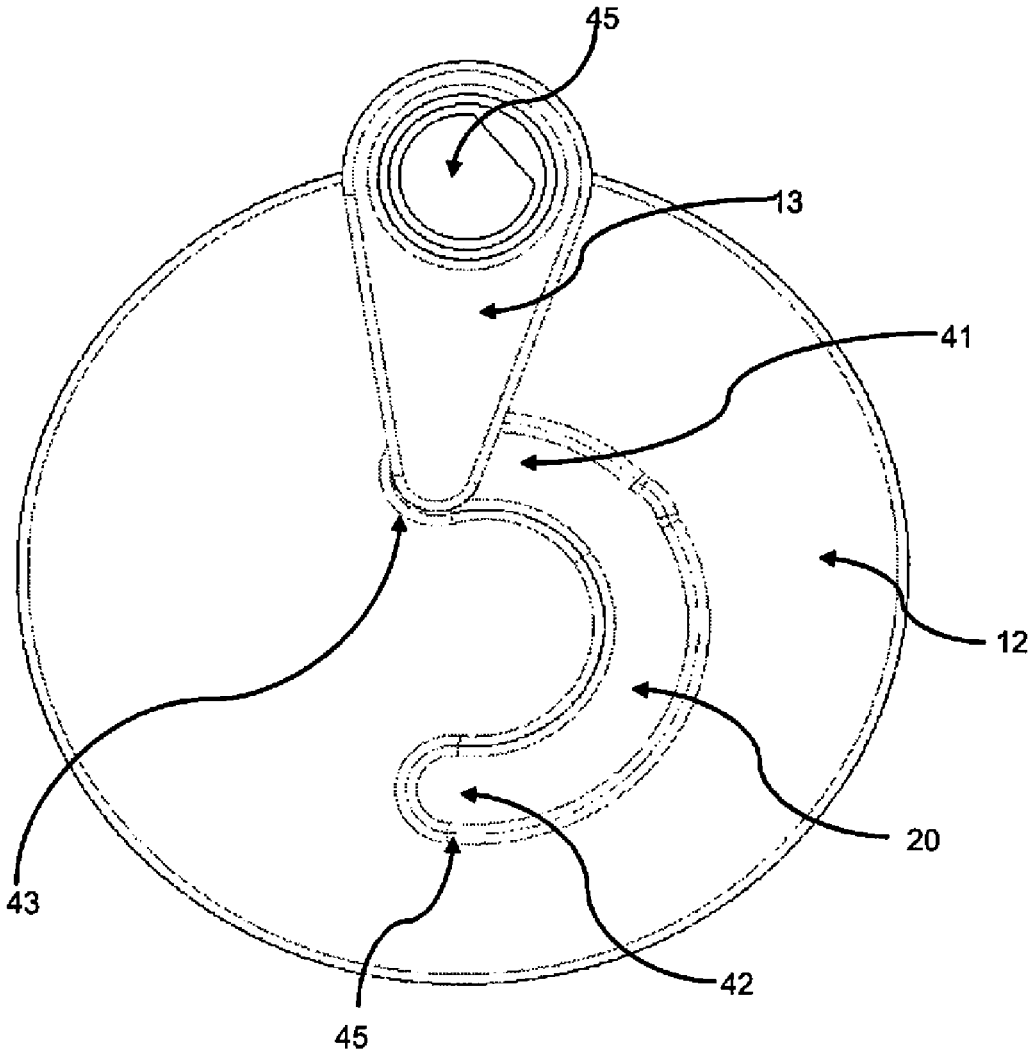
FIG. 14 is a back view of the cam and crank of the air flow control mechanism.
Figure 15:
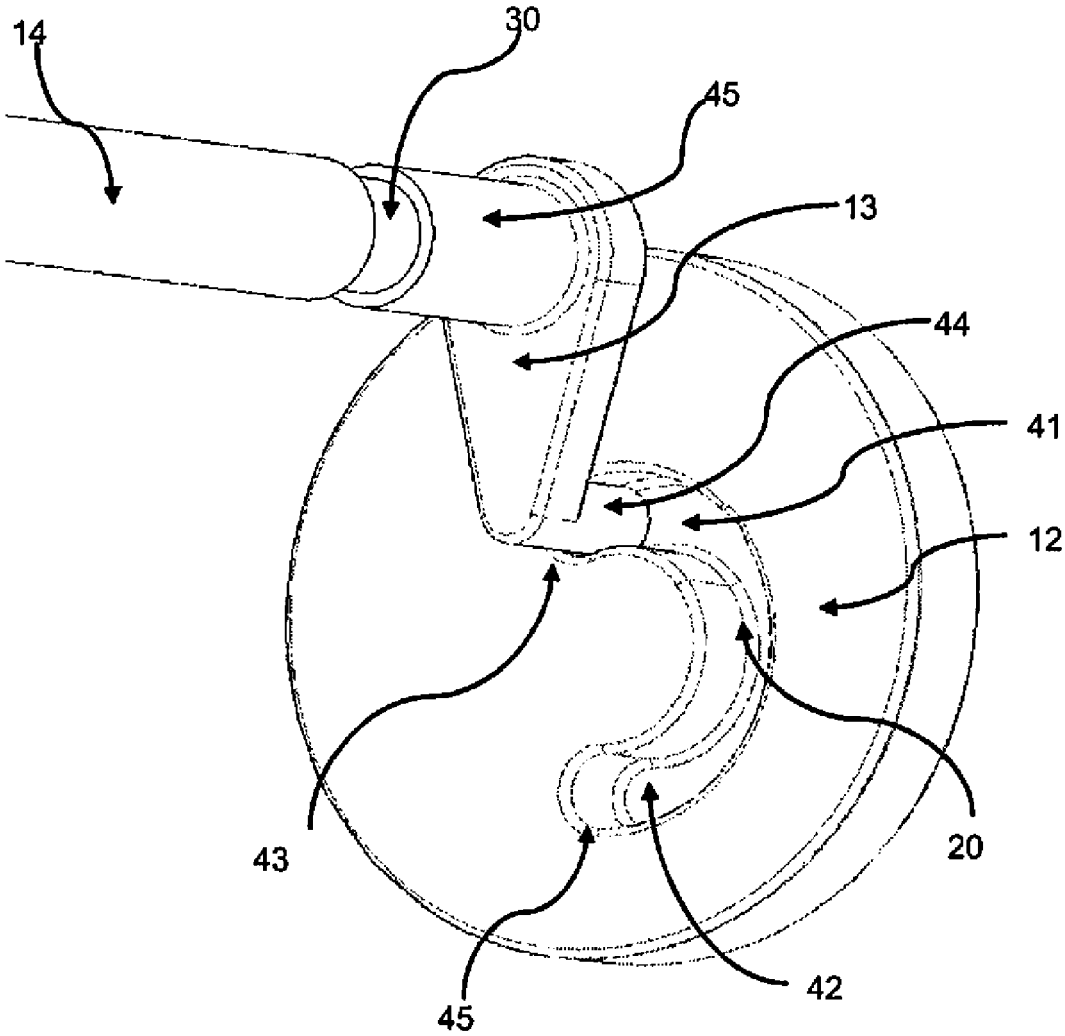
FIG. 15 is a back perspective view of the cam, crank and rod of the air flow control mechanism of the invention.

The following description should be taken into account with FIGS. 13, 14 and 15. The first end (44) of the crank (13), is fixed between the walls (43, 45) formed by the groove (20). When initiating the crank (13) first end (44) run in the initial part (41) of the groove (20), the crank is in a 0° position, and the knob is found in a minimal air flow position. When the knob (11) is rotated towards a greater air flow, the cam (12) is rotated with the same degree than the knob (11), thus the groove (20) forces the crank (13) first end (44) to start its run through said groove (20).

When rotating the knob (11) towards a greater flow, the first end (44) starts running through the groove (20) creating a torsional movement in a ring shape of said first end (44) with regards to the groove (20). Since the second end (46) is fixed with the rod (14), the torsion free movement of the first end (44), when running through the cam (12) groove (20), translates to a rotating movement of the second end (46) and the rod (14). The torsional movement of the first end (44) diminishes the rotation degree of the rotating movement of the cam (12) base, and transmits the diminished rotation degrees to the crank (13) second end (46). The torsional movement of the first end (44) diminishes the rotation degrees, since the groove is found: (a) un-centered with regards to the circle center formed by the cam, causing less traveling of the first end (44) with regards to the rotation of the cam (12) base; (b) in semi-circle shape, thus limiting the complete rotation of the cam, to a partial rotation of the first end (44) in the groove (20); and (c) the crank (13) shape, allows that in its end wherein the first end (44) is found, to have essentially the same angular displacement than the end wherein the second end (46) is found. The end of the second end (46) has a greater diameter to the diameter formed by the end of the first end (44).

The crank (13) second end (46), as seen in FIGS. 14 and 15, is a cylindrical shape, wherein the cylinder is cut by a secant. The front end (30) of the rod (14), which is solid cylindrical shape, is also cut by a secant. Therefore, the rod (14) front end (30) is fixed to the crank (13) second end (46), wherein the rod (14) and crank (13) are found fixed by the secants of their respective cylinders.

Figure 16:
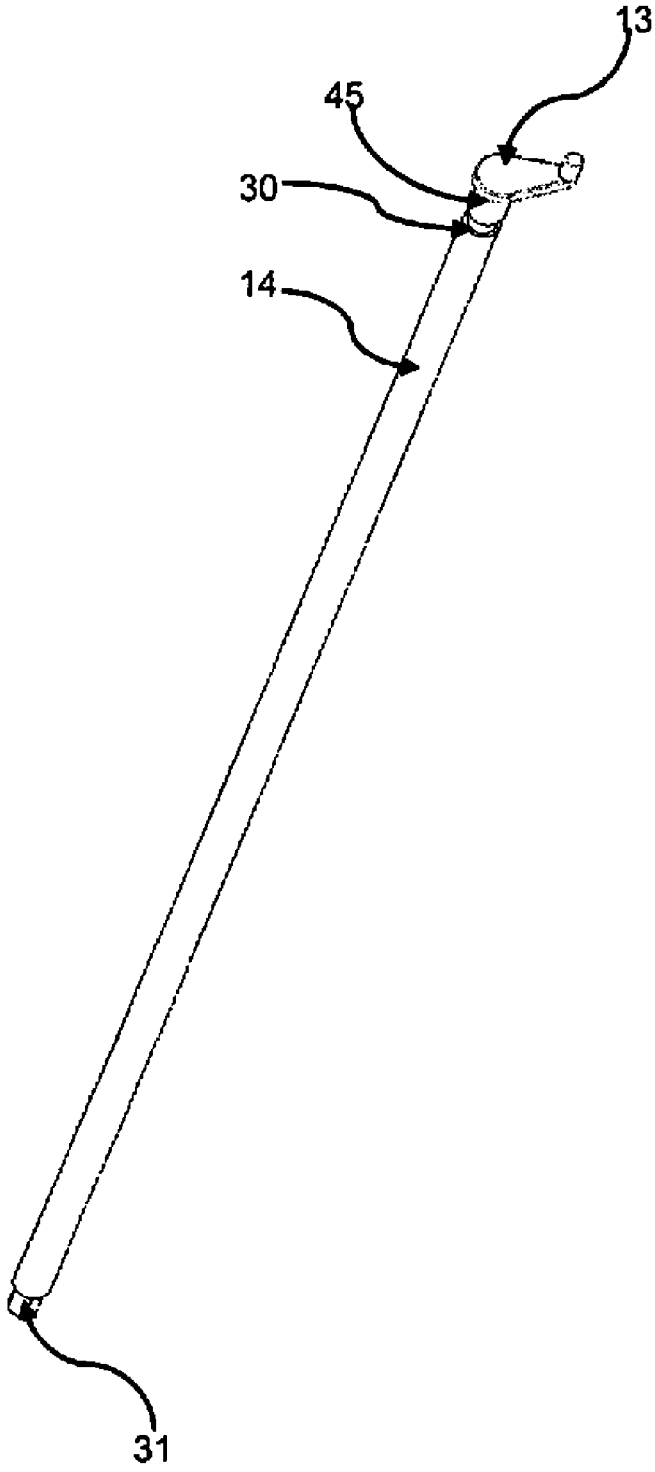
FIG. 16 is a front perspective view of the air flow control mechanism cam and crank of the invention.

FIG. 16 shows the connection between the crank (13) and the rod (14) by means of said second end (46) and the front end (30) of each part, respectively. Said rod (14) has a determined longitude, as stated before. Finally, the figure also shows the back end (31) of the rod (14). The back end (31) of the rod (14) is a hexahedron that will have a fixed connection with the obturator (15) end (24). The back end (31) may be the same piece as the rod (14).

Figure 17:
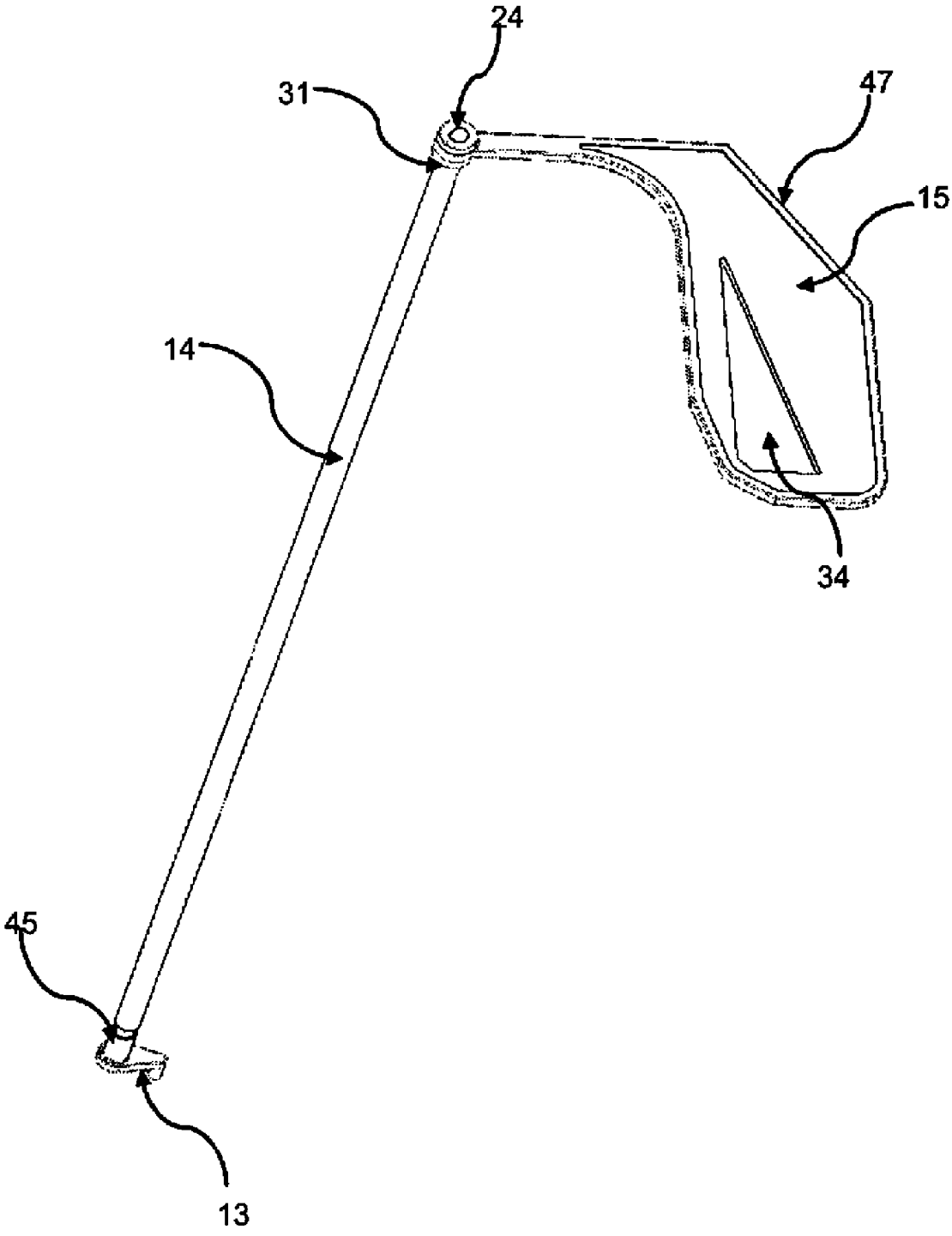
FIG. 17 is a back perspective view of the air flow control mechanism crank, rod and obturator of the invention.

FIG. 17 is a back view of the rod (14), showing the rod (14) back end (31) and the obturator (15) end (24) having a fixed connection. Therefore, rotating movement generated by the crank (13) second end (46), will be transmitted to the rod (14) and obturator (15), allowing the obturator (15) to raise or lower regarding the ports (6) which allow air flow towards the interior of the refrigerator compartment (2), that is, the obturator to rotate (15) in regards to symmetrical axis of the rod (14).

In view of the afore-mentioned, the particular shape of the obturator (15) is given. The obturator (15) preferably has the shape of a semi-rectangular paddle, wherein a rectangle first wall (47) is cut by a secant. Since the ports (6) are concentrated in the determined region (9), and since the obturator (15) rotation is not close to 90°, on the contrary, is an approximate rotation of 20° to 45°, if the obturator (15) were a complete rectangle, even if the obturator were totally rotated, a portion of the obturator (15) would obstruct air flow towards the ports (6) determined region (9). Therefore, the first wall (47) allows that when the obturator (15) is totally rotated, the obturator (15) totally releases air flow towards the ports (6).

However, the first wall (47) also allows that when the obturator (15) is in its initial position, all the obturator (15) walls obstruct the port (6) determined region (9). The only air flow allowed in this moment is by means of the obturator (15) groove (34). A minimum air flow is allowed to keep air flow circulating in the refrigerator cabinet (2) interior.

It should be noted that the obturator (15) may be of any shape, as long as it complies with the above mentioned functions.

Figure 8A:
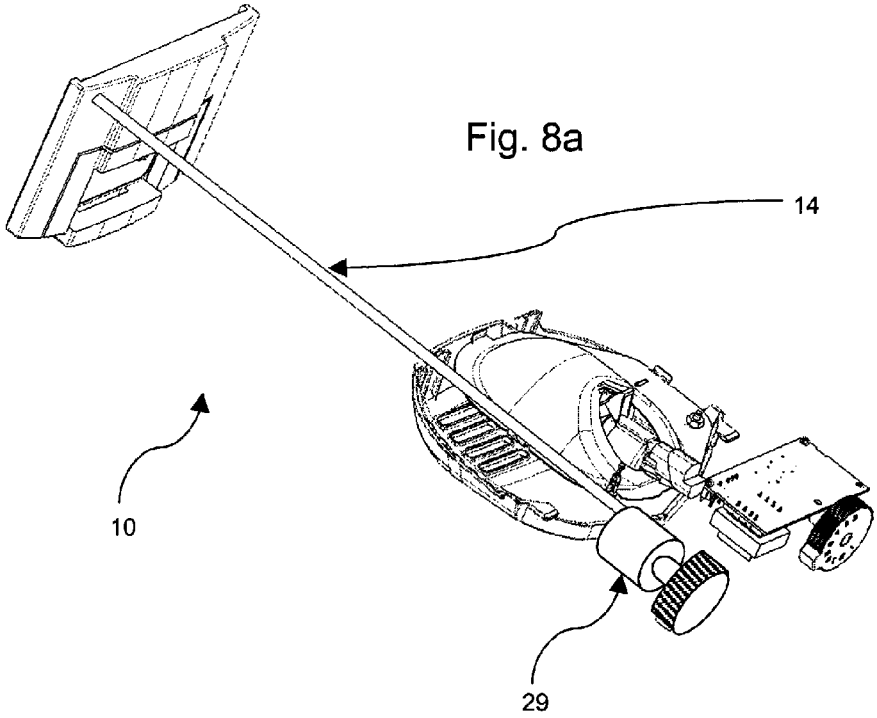
FIG. 8*a* is a front perspective view of the air flow control mechanism.

A second preferred embodiment is obtained when coupling a motor (29) is used as shown in FIG. 8*a*, possibly using a pair of sensors or switches at the end of the run, all controlled by a control system.

As shown in FIG. 8*a* the motor (29) may be coupled preferably to the cam (12). However, the motor (29) may also be coupled to the knob (11) or rod (14), by means of a gear arrangement, or by means of a pulley and bands arrangement, preferably dented, by means of friction pulleys, coinciding the rod (14) axis with the motor (29) axis, etc.

Preferably, if there is a motor (29), the interior of the groove (20) walls (43, 45) and the crank (13) first end (44), could have a plurality of splines allowing a greater precision in each of the obturator (15) positions. The above-mentioned splines, also function in the case that the mechanism lacks a motor (29).

Alterations of the structure disclosed in the specification, may be provided by those skilled in the art. However, it must be understood that the specification relates to the preferred embodiments of the invention, which is for illustrative purposes only, and should not be construed as a limitation of the invention. All modifications that do not depart from the spirit of the invention will be included in the scope of the enclosed claims.

The invention claimed is:

1. An air flow control mechanism for a refrigeration appliance comprising:

at least one knob adjustable to regulate air flow in a compartment of the appliance, the knob including a first coupler component, and wherein said knob is configured to rotate in response to an adjustment by a user;

a cam including a base, a groove and a second coupler component adapted to make a connection with the first coupler component, wherein the cam base includes the groove, wherein the groove has an arcuate shape and is positioned off-center with respect to a center of the cam base;

a crank having a first end a second end, wherein the first end is disposed in the semi-circular groove of the cam base to travel along the groove when the user adjusts the knob;

a rod having a front end and a back end, wherein the front end is connected to the second end of the crank; and an obturator connected with the rod back end;

wherein the cam base has a common rotational displacement with the knob; and wherein the common rotational displacement of the knob and cam base is transformed to a different rotational displacement transmitted through the rod to the obturator to regulate air flow in response to the adjustment by the user.

2. The control mechanism according to claim 1 wherein the knob comprises a stop, a plurality of splines and wherein the first coupler component comprises a shaft and the second coupler component comprises a receptacle to receive the shaft of the knob.

3. The control mechanism according to claim 2, wherein the cam comprises at least a first face that includes the receptacle that receives the shaft of the knob, wherein the interior of the receptacle includes a wall to secure the connection with the cam.

4. The control mechanism according to claim 1, wherein the arcuate grove is a semi-circular groove that includes a first groove segment to initiate a travel of the first end of the crank along the groove and further includes a second grove segment to end the travel of the first end of the crank along the groove, each position where the first end crank is presently located along the groove from the first groove segment to the second groove segment corresponds to a respective obturator position.

5. The control mechanism according to claim 1, wherein the mechanism further comprises a housing to house at least part of the knob, the cam, the crank, the rod and the obturator, wherein the housing comprises a plurality of air discharge ports and wherein the obturator is adapted to actuate the air discharge ports to regulate air flow through the ports in response to the adjustment by the user.

6. The control mechanism according to claim 1, wherein a first housing and a second block enclose said obturator in a shell, and wherein said first and housing and second block, have a lower and upper wall demarking the movement of the obturator.

7. The control mechanism according to claim 1, wherein the obturator has the shape of a paddle, wherein a first wall of the paddle is cut by a secant and wherein the obturator includes a groove to allow at least some air flow when the obturator is set to obstruct air flow.

8. The control mechanism according to claim 1, wherein the control mechanism further comprises a motor mechanically coupled to at least one of the cam, the knob and the rod.

9. The control mechanism according to claim 8, wherein the mechanical coupling of the motor to the at least one of the cam, the knob and the rod comprises a gear connection.

10. The control mechanism according to claim 8, wherein the mechanical coupling of the motor to the at least one of the cam, the knob and the rod comprises a pulley and band connection.

11. The control mechanism according to claim 1, wherein an inner surface of the groove and the end of the crank that travels long the groove each has a plurality of splines.

12. A refrigeration appliance including the air flow control mechanism of claim 1, wherein the refrigeration appliance is selected from the group consisting of a refrigerator and a freezer.

13. An air flow control mechanism for a refrigeration appliance comprising:

at least one knob configured to rotate in response to an adjustment by a user;

a cam including a groove, wherein the groove has a semi-circular shape and is positioned off-center with respect to a center of the cam;

a crank, wherein an end of the cam is arranged to travel along the semi-circular groove of the cam when the user adjusts the knob;

a rod, wherein said rod is connected to the crank; and an obturator connected with the rod;

wherein the cam has a common rotational displacement with the knob; and wherein the common rotational displacement of the knob and cam is transformed to a torsional movement transmitted from the crank through the rod to the obturator to regulate air flow in response to the adjustment by the user.

14. An air flow control mechanism for a refrigeration appliance comprising:

a knob configured to rotate;

a cam including a groove, wherein the groove has an arcuate shape and is positioned off-center relative to the cam and the cam is connected to the knob;

a crank, wherein an end of the crank is inserted to travel along the arcuate groove of the cam when the user adjusts the knob;

a rod connected to the crank; and an obturator connected to the rod;

wherein a rotational movement of the knob is transformed to a torsional movement of the crank adapted to reduce rotation degrees of the rotational movement of the knob, and is further adapted so that the reduced rotation degrees is transmitted through the rod to the obturator to regulate air flow in response to the adjustment by the user.

15. A method for controlling air flow in a refrigeration appliance comprising:

connecting a knob to a cam;

defining an arcuate groove in the cam and positioning the groove off-center relative to a center of the cam;

rotating the knob and the cam, the rotating effecting a common rotational displacement of the knob and cam;

connecting a first end of a crank to travel along the groove;

in response to the rotating of the knob and cam, causing the first end of the crank to travel along the groove to effect a tortional movement of the first end of the crank about the groove;

as the first end of the crank travels along the groove, diminishing the common rotational displacement of the knob and cam;

transmitting the diminished rotational displacement to a second end of the crank;

connecting the second end of the crank to a rod; and transmitting the diminished rotational displacement though the rod to an obturator to regulate air flow in a compartment of the appliance in response to the adjustment by the user.

16. The method according to claim 15, further comprising bounding a rotational movement of the obturator between an upper wall and a lower wall.

17. The method according to claim 15, further comprising mechanically coupling an electromotive machine to at least one of the cam, the knob and the rod to effect at least one of the tortional movement and the rotational displacement of the rod.

18. The method according to claim 17, wherein the mechanical coupling of the electromotive machine to the at least one of the cam, the knob and the rod is selected from the group consisting of a gearing coupling, a pulley and band coupling and a direct coupling.

* * * * *

UNITED STATES PATENT AND TRADEMARK OFFICE

CERTIFICATE OF CORRECTION

PATENT NO. : 7,874,172 B2
APPLICATION NO. : 12/173178
DATED : January 25, 2011
INVENTOR(S) : Marco Antonio Solis Cruz and Victor Hugo Miranda Razo It is certified that error appears in the above-identified patent and that said Letters Patent is hereby corrected as shown below:

ON THE TITLE PAGE item (73) should read:
(73) Assignee: MABE S.A. DE C.V.
Queretaro, QRO (MX)

Signed and Sealed this
Twentieth Day of December, 2011

David J. Kappos

David J. Kappos
*Director of the United States Patent and Trademark Office*